US011083049B2

(12) United States Patent
Ko et al.

(10) Patent No.: US 11,083,049 B2
(45) Date of Patent: Aug. 3, 2021

(54) TRANSPARENT PLANAR HEATING FILM INCLUDING TRANSFERRED METAL NANOPARTICLES

(71) Applicants: KOREA INSTITUTE OF SCIENCE AND TECHNOLOGY, Seoul (KR); IM Co., Ltd., Yongin-si (KR)

(72) Inventors: Hyungduk Ko, Seoul (KR); Ji Hun Park, Seoul (KR); Ki-sun Park, Seoul (KR); Min Ji Park, Seoul (KR); Kwan Il Lee, Seoul (KR)

(73) Assignees: Korea Institute of Science and Technology, Seoul (KR); IM Co., Ltd., Yongin-si (KR)

( * ) Notice: Subject to any disclaimer, the term of this patent is extended or adjusted under 35 U.S.C. 154(b) by 252 days.

(21) Appl. No.: 16/217,147

(22) Filed: Dec. 12, 2018

(65) Prior Publication Data

US 2020/0107406 A1 Apr. 2, 2020

(30) Foreign Application Priority Data

Oct. 1, 2018 (KR) ..... 10-2018-0116892

(51) Int. Cl.
*H05B 3/00* (2006.01)
*H05B 3/03* (2006.01)
(Continued)

(52) U.S. Cl.
CPC ..... *H05B 3/0014* (2013.01); *H05B 3/03* (2013.01); *H05B 3/16* (2013.01); *H05B 3/34* (2013.01);
(Continued)

(58) Field of Classification Search
CPC ..... H05B 3/0014; H05B 3/03; H05B 3/16; H05B 3/84; H05B 3/141; H05B 3/86; H05B 3/12; H05B 3/20; H05B 2203/017; H05B 2203/013; H05B 2214/04; H01L 33/42; H01L 31/022466; H01L 31/022475;
(Continued)

(56) References Cited

U.S. PATENT DOCUMENTS

2015/0053950 A1* 2/2015 Suematsu ..... H05K 1/0274 257/40

FOREIGN PATENT DOCUMENTS

JP 2006-054212 A 2/2006
KR 10-1465518 B1 11/2014
(Continued)

*Primary Examiner* — Shawntina T Fuqua
(74) *Attorney, Agent, or Firm* — Rabin & Berdo, P.C.

(57) ABSTRACT

A transparent planar heating film includes metal nanoparticles that are disposed on at least a portion of a transparent adhesive film; and a transparent electrode that is completely covered by the transparent adhesive film and has a conductive surface that is laminated to and in direct contact with the metal nanoparticles via the transparent adhesive film. The heating temperature of the transparent planar heating film is a maximum of at least two times higher at the same power consumption than that of conventional planar heating films. Both the transparent adhesive film and the transparent electrode may be flexible so that the transparent planar heating film is flexible. In the transparent planar heating film, the metal nanoparticles may be bonded to desired locations on the conductive surface of the transparent electrode enabling selective heating.

9 Claims, 4 Drawing Sheets

(51) Int. Cl.
*H05B 3/16* (2006.01)
*H05B 3/84* (2006.01)
*H05B 3/34* (2006.01)

(52) U.S. Cl.
CPC ..... *H05B 3/84* (2013.01); *H05B 2203/013* (2013.01); *H05B 2203/017* (2013.01)

(58) Field of Classification Search
CPC ..... H01L 31/022491; H01L 51/5215; H01L 51/529; H01L 51/442; H01L 51/5212; H01L 51/0097; H01L 29/413; C08J 7/044; C08J 7/06; B82Y 10/00; B82Y 30/00
See application file for complete search history.

(56) References Cited

FOREIGN PATENT DOCUMENTS

| | | |
|---|---|---|
| KR | 10-1726492 B1 | 4/2017 |
| KR | 10-1840339 B1 | 3/2018 |

* cited by examiner

TRANSPARENT PLANAR HEATING FILM INCLUDING TRANSFERRED METAL NANOPARTICLES

CROSS-REFERENCE TO RELATED APPLICATIONS

This application claims priority under 35 U.S.C. § 119 to Korean Patent Application No. 10-2018-0116892 filed on Oct. 1, 2018 in the Korean Intellectual Property Office, the disclosure of which is incorporated herein by reference in its entirety.

BACKGROUND OF THE INVENTION

1. Field of the Invention

The present invention relates to a transparent planar heating film whose heating temperature is a maximum of at least two times higher at the same power consumption than that of conventional planar heating films and in which a metal nanoparticle film is bonded to a desired location on the surface of a transparent electrode, enabling selective heating, and a method for manufacturing the transparent planar heating film.

2. Description of the Related Art

Generally, transparent planar heating films are used in applications where high visibility is needed, for example, glass surfaces of refrigeration cabinets, window and door systems, automotive glass surfaces, and bathroom mirrors. In the above-exemplified applications, transparent planar heating films are mainly used for the purposes of reducing or eliminating inconvenience caused by fogging or dew condensation due to a temperature difference from ambient temperature.

Generally, hot-air blowers or heating wire glass is mainly used to avoid the occurrence of fogging or dew condensation. Anti-fogging coatings using surfactants are also used for the same purpose. Automotive glass in the form of a heating plate is a typical structure using heating wires for avoiding the occurrence of fogging or dew condensation. The automotive glass has a structure in which opaque or translucent linear resistance wires (or heating wires) are disposed on a transparent base. The resistance wires of the heating plate release different amounts of heat at their different sites because of their non-uniform resistance. The resistance wires block driver's view. Heat is released along the resistance wires and is thus transferred later to portions where the resistance wires are not disposed. This later heat transfer makes it impossible to completely uniformly eliminate the occurrence of fogging or dew condensation.

Transparent conductive heating films (i.e. transparent planar heating films) have been developed aimed at solving the problems of resistance wires, including driver's view obstruction and non-uniform heating.

Such transparent planar heating films have a general structure in which a transparent conductive heating material is coated on a transparent non-conductive substrate and electrodes are disposed at both ends of the conductive heating material. When a direct or alternating voltage is applied to both electrodes, an electric current flows through the conductive heating material to release heat. In this structure, however, heat is released from the outer portions of the transparent planar heating film and no heat release occurs in the central portion thereof after a voltage is applied to both electrodes.

In an attempt to solve the above problems, a proposal has been made for a method in which patterned electrodes are disposed over the entire surface of a transparent planar heating film. However, local overheating occurs in the transparent planar heating film. This local overheating makes it difficult to activate the transparent planar heating film for a long time. Further, the transparent planar heating film cannot be applied to windows and doors for buildings due to its high haze.

PRIOR ART DOCUMENTS

Patent Documents

Korean Patent No. 1465518
Korean Patent No. 1840339

SUMMARY OF THE INVENTION

One object of the present invention is to provide a transparent planar heating film whose heating temperature is a maximum of at least two times higher at the same power consumption than that of conventional planar heating films and in which a metal nanoparticle film is bonded to a desired location on the surface of a transparent electrode, enabling selective heating.

A further object of the present invention is to provide a method for manufacturing the transparent planar heating film.

A transparent planar heating film according to one aspect of the present invention includes a transparent electrode, metal nanoparticles transferred to the upper surface of the transparent electrode, and a transparent adhesive film attached to the upper surface of the metal nanoparticles.

The transparent electrode may be made of a material selected from the group consisting of indium tin oxide (ITO), zinc oxide (ZnO), fluorine-doped tin oxide (FTO), and aluminum-doped zinc oxide (AZO).

The metal nanoparticles may be nanoparticles of a metal selected from the group consisting of Ag, Al, Au, Cu, W, Cr, Ti, and alloys thereof.

The metal nanoparticles may have an average diameter of 3 to 500 nm.

The transparent adhesive film may be made of at least one material selected from the group consisting of polyethylene, polyethylene terephthalate, polyimide, polydimethylsiloxane (PDMS), polyester, polyurethane, polyamide, and ethyl vinyl acetate.

A method for manufacturing a transparent planar heating film according to a further aspect of the present invention includes (A) depositing a thin metal film on a surface-treated substrate, (B) physically treating the deposited thin metal film to form metal nanoparticles, (C) separating the metal nanoparticles from the substrate with an adhesive film, and (D) attaching the metal nanoparticles attached to the adhesive film to a transparent electrode such that the metal nanoparticles are brought into contact with the transparent electrode.

In step (A), the substrate may be selected from the group consisting of silicon, glass, and $SiO_2$ substrates.

In step (A), the thin metal film may be deposited to a thickness of 1 to 25 nm.

In step (A), the thin metal film may be deposited by a process selected from the group consisting of physical vapor deposition (PVD), chemical vapor deposition, spray coating, roll coating, bar coating, dip coating, and spin coating.

In step (B), the physical treatment may be thermal or photo treatment.

The metal nanoparticles formed in step (B) may have an average diameter of 3 to 500 nm.

The transparent planar heating film of the present invention is flexible and has a maximum of at least two-fold higher heating temperature at the same power consumption than conventional planar heating films. In the transparent planar heating film of the present invention, the metal nanoparticle film is bonded to a desired location on the surface of the transparent electrode, enabling selective heating.

In addition, the transparent planar heating film of the present invention can maintain its heating state for a long time due to its latent heat properties even when power is cut off, contributing to energy saving. The presence of the metal nanoparticles ensures improved strength of the transparent planar heating film according to the present invention. Thus, the transparent planar heating film of the present invention can be used to prevent breakage of glass surfaces of refrigeration cabinets, window and door systems, automotive glass surfaces, and bathroom mirrors.

Furthermore, the transparent planar heating film of the present invention can be activated for a long time because its heat release is uniform as a whole. Due to its low haze, the transparent planar heating film of the present invention can be used in various applications, for example, windows and doors for buildings.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE INVENTION

Figure 1:
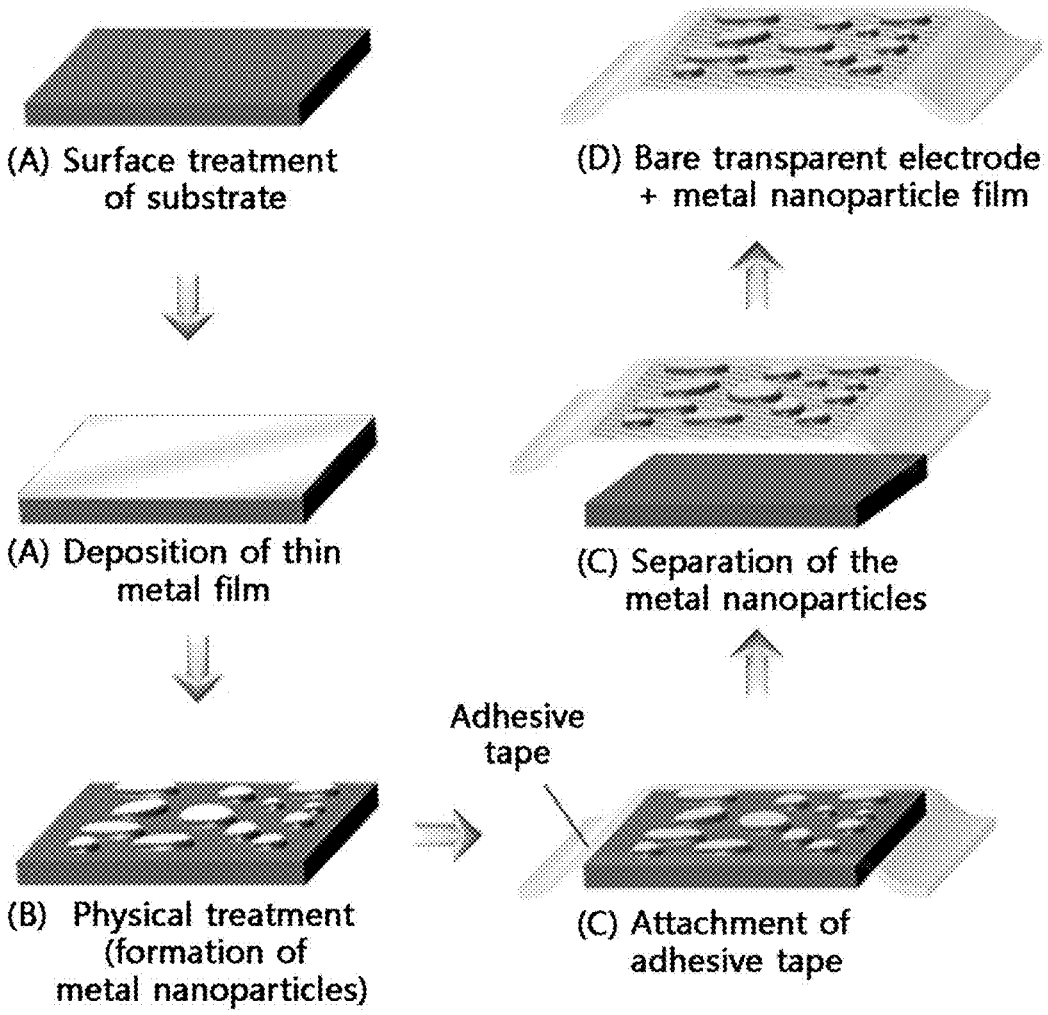
FIG. 1 is a flowchart illustrating a method for manufacturing a transparent planar heating film according to one embodiment of the present invention.

The present invention is directed to a transparent planar heating film whose heating temperature is a maximum of at least two times higher at the same power consumption than that of conventional planar heating films and in which a metal nanoparticle film is bonded to a desired location on the surface of a transparent electrode, enabling selective heating, and a method for manufacturing the transparent planar heating film.

The present invention will now be described in detail.

A transparent planar heating film of the present invention includes a transparent electrode (also referred to as a "transparent flexible electrode"), metal nanoparticles transferred to the upper surface of the transparent electrode, and a transparent adhesive film attached to the upper surface of the metal nanoparticles.

The transparent electrode receives external power and applies an electric current such that the electric current flows through the metal nanoparticles. Specifically, the transparent electrode may be made of a material selected from the group consisting of indium tin oxide (ITO), zinc oxide (ZnO), fluorine-doped tin oxide (FTO), and aluminum-doped zinc oxide (AZO).

The metal nanoparticles receive an electric current from the transparent electrode to release heat. Particularly, due to the presence of the metal nanoparticles transferred to the upper surface of the transparent electrode, the transparent planar heating film of the present invention has a maximum of at least two-fold higher heating temperature at the same power consumption than conventional planar heating films without metal nanoparticles. The use of the transparent adhesive film allows the transparent planar heating film of the present invention to have latent heat properties. Specifically, it takes a 20 to 30% longer time until the elevated temperature of the transparent planar heating film according to the present invention falls to room temperature after power is cut off than that of conventional planar heating films. Therefore, the use of the transparent planar heating film according to the present invention can reduce energy consumption. The metal nanoparticles are not especially limited but are preferably selected from the group consisting of Ag, Al, Au, Cu, W, Cr, and Ti nanoparticles.

The metal nanoparticles have an average diameter of 3 to 500 nm, preferably 5 to 300 nm. If the average diameter of the metal nanoparticles is less than the lower limit defined above, no improvement in heat release properties cannot be expected. Meanwhile, if the average diameter of the metal nanoparticles exceeds the upper limit defined above, the metal nanoparticles are very difficult to transfer to the adhesive film or, even if transferred, the haze of the transparent planar heating film increases greatly, resulting in low flexibility as well as poor visibility of the heating film.

The use of the transparent adhesive film in combination with the metal nanoparticles allows the transparent planar heating film of the present invention to have latent heat properties and assists in facilitating the bonding of the metal nanoparticles to the transparent electrode. The transparent adhesive film is not especially limited as long as it has the above-mentioned characteristics but is preferably made of at least one material selected from the group consisting of polyethylene, polyethylene terephthalate, polyimide, polydimethylsiloxane (PDMS), polyester, polyurethane, polyamide, and ethyl vinyl acetate.

The present invention also provides a method for manufacturing a transparent planar heating film.

Specifically, the method of the present invention includes (A) depositing a thin metal film on a surface-treated substrate, (B) physically treating the deposited thin metal film to form metal nanoparticles, (C) separating the metal nanoparticles from the substrate with an adhesive film, and (D) attaching the metal nanoparticles attached to the adhesive film to a transparent electrode such that the metal nanoparticles are brought into contact with the transparent electrode.

In step (A), a thin metal film is deposited on a surface-treated substrate.

The substrate is made of a material that can withstand subsequent physical treatment performed to form metal nanoparticles and facilitates separation of the metal nanoparticles. Specifically, any semiconducting or insulating material (such as an oxide or nitride) except a metal or metal alloy may be used without particular limitation for the substrate. Preferably, the substrate is selected from the group consisting of silicon, glass, and $SiO_2$ substrates.

The surface of the substrate is treated with an organic solvent. This surface treatment facilitates the separation of metal nanoparticles in the subsequent step.

The material for the thin metal film is not limited to a particular metal but is preferably selected from Ag, Al, Au, Cu, W, Cr, Ti, and alloys thereof. Any known deposition process may be used without particular limitation to deposit the thin metal film. Preferably, the thin metal film is deposited by a process selected from the group consisting of physical vapor deposition (PVD), chemical vapor deposition, spray coating, roll coating, bar coating, dip coating, and spin coating.

The thickness of the deposited thin metal film is in the range of 1 to 25 nm, preferably 1 to 15 nm. If the thickness of the thin metal film is less than the lower limit defined above, no improvement in heat release properties cannot be expected. Meanwhile, if the thickness of the deposited thin metal film exceeds the upper limit defined above, metal nanoparticles are impossible to transfer to an adhesive film in the subsequent step and no improvement in heat release properties cannot be expected.

Next, in step (B), the deposited thin metal film is physically treated to form metal nanoparticles.

The physical treatment may be thermal treatment such as heating or photo treatment such as light irradiation.

The thermal treatment is performed at 80 to 400° C., preferably 100 to 300° C. for 1 to 60 minutes, preferably 1 to 30 minutes. The thermal treatment is performed under ambient air, vacuum or inert gas conditions. If the thermal treatment temperature and time are outside the respective preferred ranges defined above or satisfy only one of the two conditions, the thin metal film is not formed into metal nanoparticles or, even if formed, the average diameter of the metal nanoparticles is outside the range defined above, resulting in poor heat release properties.

Examples of light sources for the photo treatment include, but are not particularly limited to, infrared lamps, xenon lamps, YAG lasers, argon lasers, carbon dioxide lasers, and XeF, XeCl, XeBr, KrF, KrCl, ArF and ArCl excimer lasers, which are generally at powers of 10 to 5000 W. The power of a light source used in the present invention is in the range of 100 to 1000 W.

In steps (C) and (D), the metal nanoparticles are separated from the substrate with an adhesive film (step (C)) and the metal nanoparticles attached to the adhesive film are attached to a transparent electrode such that the metal nanoparticles are brought into contact with the transparent electrode (step (D)).

Specifically, an adhesive film is attached to one surface of the substrate/metal nanoparticles structure formed in step (B) where the metal nanoparticles are formed, and is then detached from the substrate. As a result, the metal nanoparticles are separated from the substrate and are attached to the adhesive film. The resulting adhesive film attached with the metal nanoparticles is referred to as "metal nanoparticle film".

The metal nanoparticle film separated from the substrate is attached to a transparent electrode to manufacture a transparent planar heating film.

The metal nanoparticles are less likely to be directly formed on the upper surface of the transparent electrode. Thus, the metal nanoparticle film is attached to the transparent electrode in the present invention instead of forming the metal nanoparticles on the transparent electrode.

A heating film manufactured by directly transferring metal nanoparticles to an adhesive film and attaching the metal nanoparticles to a transparent electrode has a non-uniform heating temperature and is not flexible, unlike the heating film of the present invention in which metal nanoparticles are directly formed from a thin metal film. A heating film using a thin metal film instead of metal nanoparticles has poor latent heat properties and cannot be activated for a long time.

The following examples are provided to assist in further understanding of the invention. However, these examples are intended for illustrative purposes only. It will be evident to those skilled in the art that various modifications and changes can be made without departing from the scope and spirit of the invention and such modifications and changes are encompassed within the scope of the appended claims.

Example 1

Figure 2:
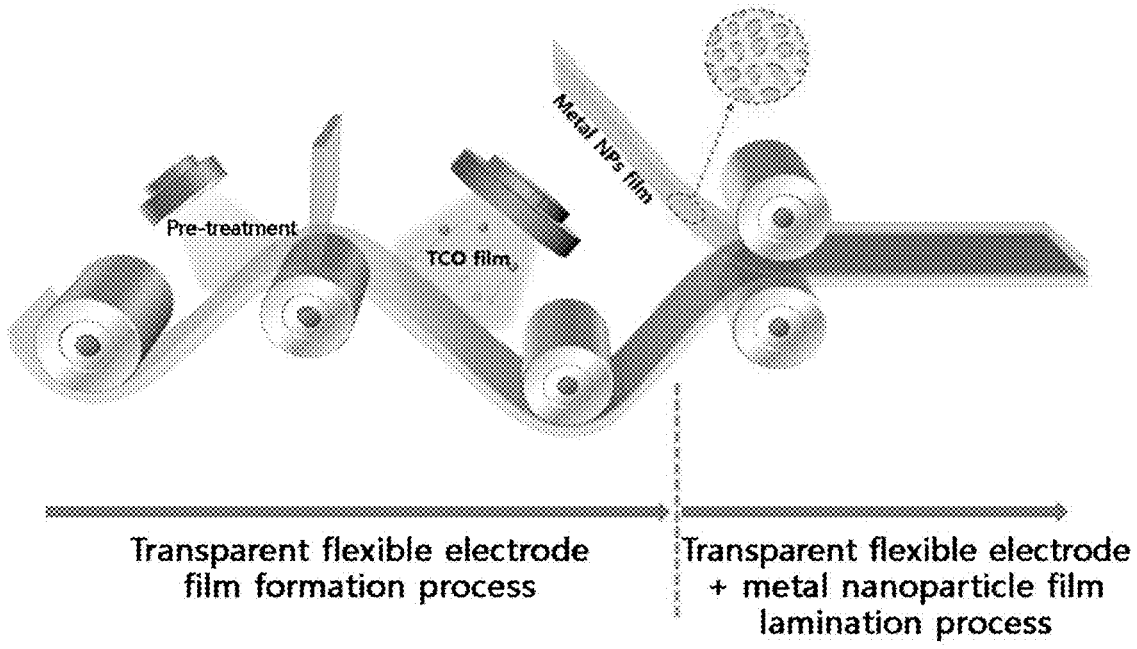
FIG. 2 is a diagram illustrating the attachment of a metal nanoparticle film to a transparent electrode by a roll-to-roll process in accordance with one embodiment of the present invention.
Figure 3:
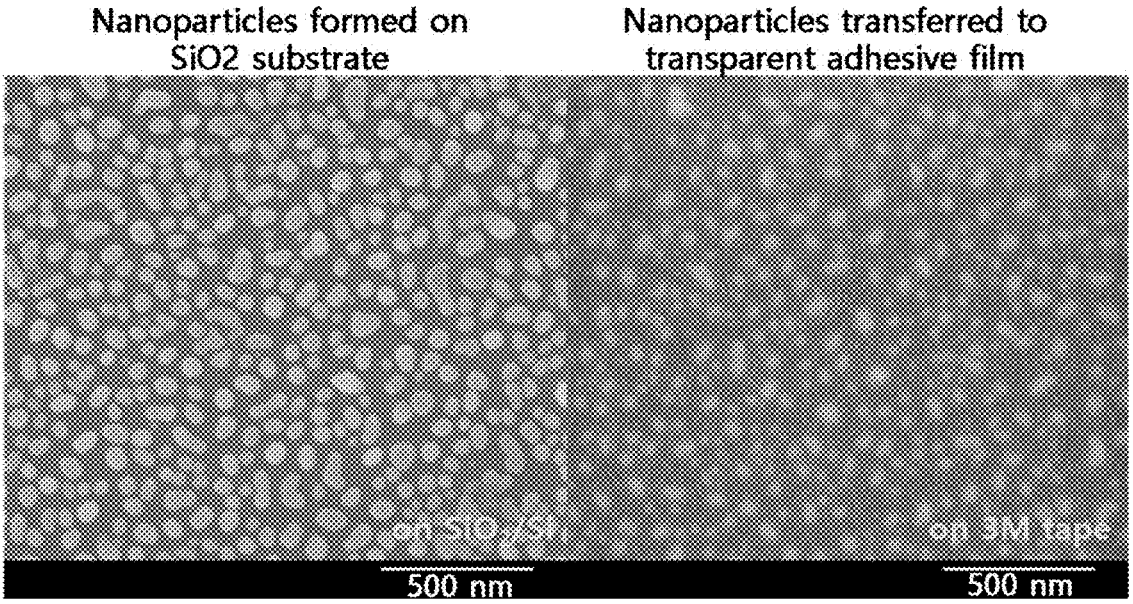
FIG. 3 shows a SEM image (left) of metal nanoparticles formed on a $SiO_2$ substrate and a SEM image (right) of metal nanoparticles attached to an adhesive film in Example 1.

A $SiO_2$ substrate was immersed in a DTS solution (a mixture of 1 ml of trichlorododecylsilane and 20 ml of toluene) at room temperature for 1 h, sonicated in toluene, and deposited with silver (Ag) to a thickness of 10 nm using a thermal evaporator. The deposited thin silver film was annealed in a furnace at 200° C. for 20 min to form metal nanoparticles with an average diameter of 130 nm. The metal nanoparticles formed on the $SiO_2$ substrate are shown in the left SEM image of FIG. 3. An adhesive film was attached to the surface of the $SiO_2$ substrate where the metal nanoparticles were formed, and was then detached from the substrate. At this time, the metal nanoparticles were naturally separated from the substrate. The resulting adhesive film attached with the metal nanoparticles (see the right SEM image of FIG. 3) was attached to a transparent electrode by using a roll-to-roll process, as illustrated in FIG. 2, such that the metal nanoparticles were brought into contact with the transparent electrode, completing the manufacture of a transparent planar heating film.

Comparative Example 1

Fluorine-doped tin oxide (FTO) was deposited on a PET substrate to manufacture a planar heating film.

Test Example

Test Example 1: Measurement of Heat Release Properties

Figure 4:
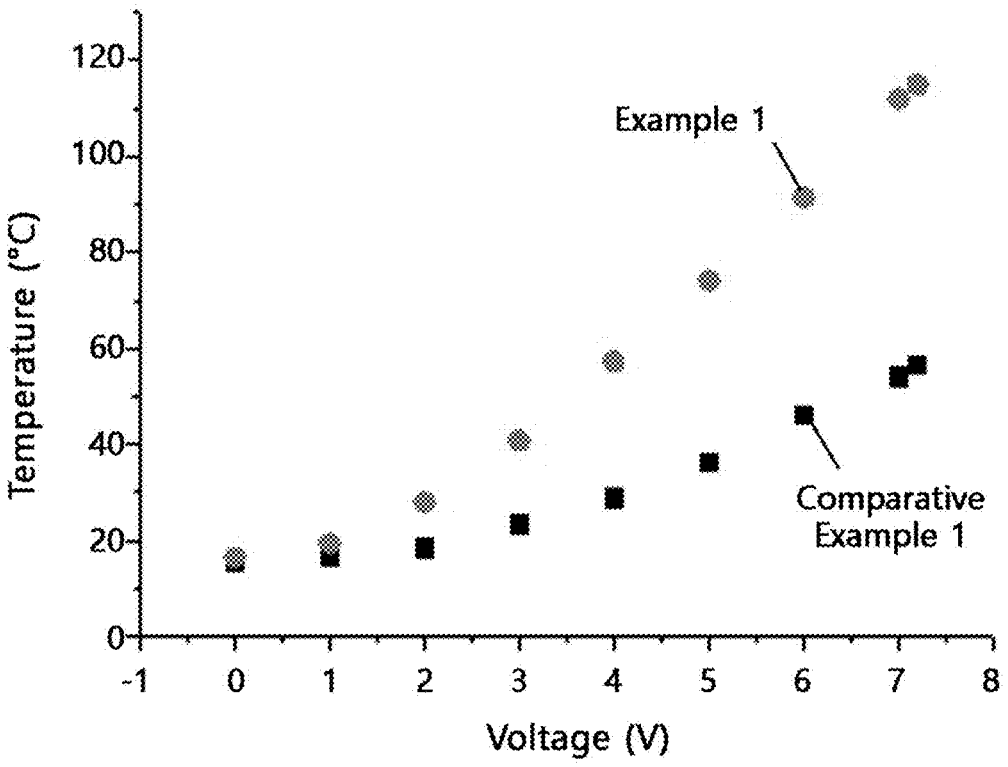
FIG. 4 shows heating temperatures of transparent planar heating films manufactured in Example 1 and Comparative Example 1, which were measured as a function of applied voltage.
Figure 5:
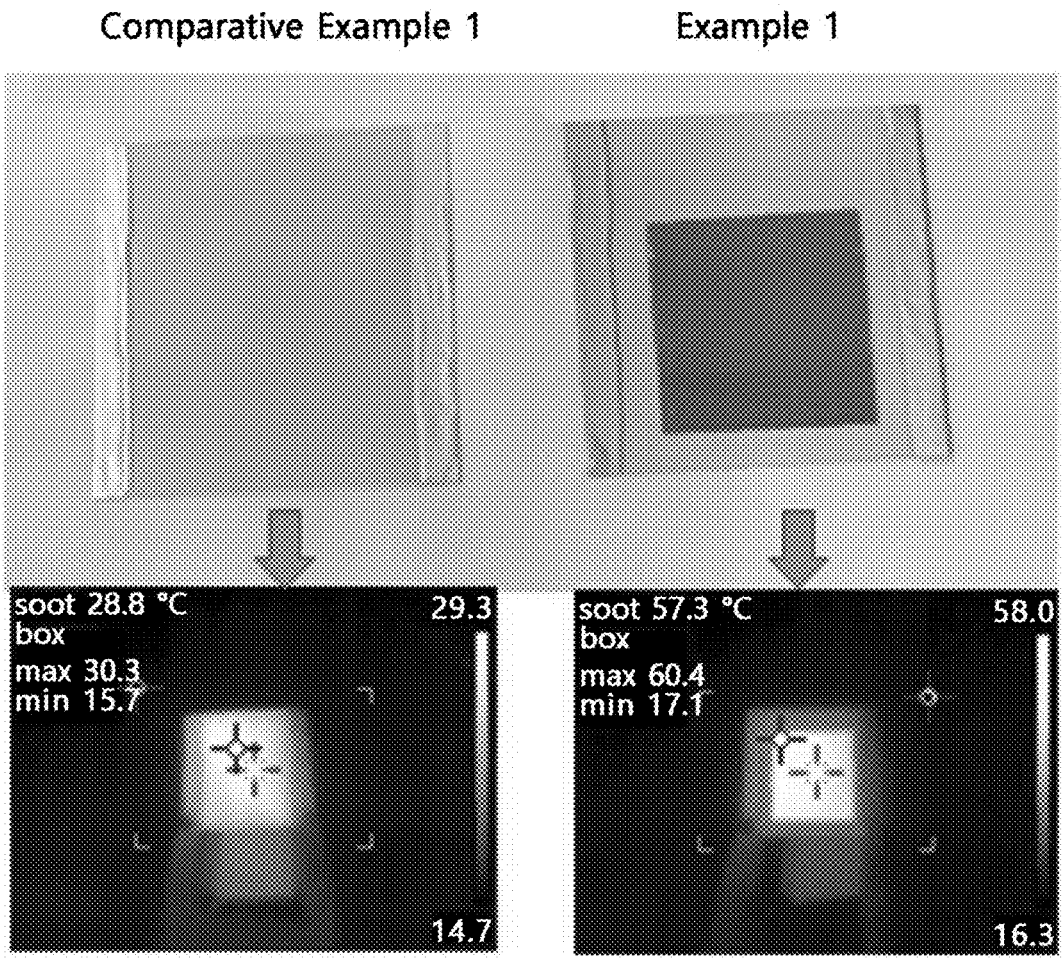
FIG. 5 shows temperature distributions of transparent planar heating films manufactured in Example 1 and Comparative Example 1.

FIG. 4 shows heating temperatures of the transparent planar heating films manufactured in Example 1 and Comparative Example 1, which were measured as a function of applied voltage, and FIG. 5 shows temperature distributions of the transparent planar heating films manufactured in Example 1 and Comparative Example 1. Each of the transparent planar heating films shown in FIG. 5 was attached to a portion of the transparent electrode.

As shown in FIG. 4, the transparent planar heating film of Example 1 showed much higher heating temperatures than that of Comparative Example 1 at the same voltages. The heat released from the transparent planar heating film of Example 1 reached a maximum of 120° C. Particularly, when a voltage of 6 V or above was applied, the heating temperature of the transparent planar heating film of Example 1 was at least twice that of Comparative Example 1.

As shown in FIG. 5, the transparent planar heating film of Example 1 showed high heating temperatures compared to that of Comparative Example 1. FIG. 5 confirms planar heat release from the transparent planar heating film of Example 1 other than local heat release.

Due to its high transmittance and low sheet resistance, the transparent planar heating film of the present invention can be used in various applications where high optical transparency is required.

What is claimed is:

1. A transparent planar heating film, comprising:

metal nanoparticles that are disposed on at least a portion of a transparent adhesive film; and a transparent electrode that is completely covered by the transparent adhesive film and has a conductive surface that is laminated to and in direct contact with the metal nanoparticles via the transparent adhesive film.

2. The transparent planar heating film according to claim 1, wherein the conductive surface of the transparent electrode is made of a material selected from the group consisting of indium tin oxide (ITO), zinc oxide (ZnO), fluorine-doped tin oxide (FTO), and aluminum-doped zinc oxide (AZO).

3. The transparent planar heating film according to claim 1, wherein the metal nanoparticles are nanoparticles of a metal selected from the group consisting of Ag, Al, Au, Cu, W, Cr, Ti, and alloys thereof.

4. The transparent planar heating film according to claim 1, wherein the metal nanoparticles have an average diameter of 3 to 500 nm.

5. The transparent planar heating film according to claim 1, wherein the transparent adhesive film comprises an adhesive material disposed on a polymeric film comprising a polymeric material selected from the group consisting of polyethylene, polyethylene terephthalate, polyimide, polydimethylsiloxane (PDMS), polyester, polyurethane, polyamide, ethyl vinyl acetate, and combinations thereof.

6. The transparent planar heating film according to claim 1, wherein both the transparent adhesive film and the transparent electrode are flexible so that the transparent planar heating film is flexible.

7. The transparent planar heating film according to claim 6, wherein the transparent adhesive film and the transparent electrode are laminated in a roll-to-roll process.

8. The transparent planar heating film according to claim 1, wherein the metal nanoparticles are disposed on at least one predetermined portion of the transparent adhesive film so that selective heating of the laminated transparent electrode is enabled.

9. The transparent planar heating film according to claim 1, wherein the metal nanoparticles are disposed in a structure constituted to release heat when an electric current from the transparent electrode is received.

* * * * *